US008248305B2

(12) United States Patent
Curran et al.

(10) Patent No.: US 8,248,305 B2
(45) Date of Patent: Aug. 21, 2012

(54) ANTENNAS BASED ON A CONDUCTIVE POLYMER COMPOSITE AND METHODS FOR PRODUCTION THEREOF

(75) Inventors: Seamus Curran, Pearland, TX (US); Jamal Talla, Al-Ehssa (SA); Sampath Dias, Houston, TX (US)

(73) Assignee: University of Houston, Houston, TX (US)

( * ) Notice: Subject to any disclaimer, the term of this patent is extended or adjusted under 35 U.S.C. 154(b) by 540 days.

(21) Appl. No.: 12/474,019

(22) Filed: May 28, 2009

(65) Prior Publication Data

US 2009/0295644 A1 Dec. 3, 2009

Related U.S. Application Data

(60) Provisional application No. 61/058,352, filed on Jun. 3, 2008.

(51) Int. Cl.
*H01Q 1/38* (2006.01)

(52) U.S. Cl. ..... 343/700 MS

(58) Field of Classification Search ..... 343/701–703, 343/700 MS, 700 R, 904; 73/774–777
See application file for complete search history.

(56) References Cited

U.S. PATENT DOCUMENTS

| | | | | |
|---|---|---|---|---|
| 6,683,783 | B1 | 1/2004 | Liu et al. | |
| 7,421,321 | B2 * | 9/2008 | Breed et al. | 701/29 |
| 7,501,985 | B2 * | 3/2009 | Qian et al. | 343/702 |
| 7,898,481 | B2 * | 3/2011 | Qian et al. | 343/700 MS |
| 2005/0179594 | A1 | 8/2005 | Morikawa et al. | |
| 2007/0138010 | A1 | 6/2007 | Ajayan | |
| 2008/0044651 | A1 * | 2/2008 | Douglas | 428/339 |
| 2008/0086876 | A1 | 4/2008 | Douglas | |
| 2009/0160728 | A1 * | 6/2009 | Emrick et al. | 343/893 |
| 2009/0174606 | A1 * | 7/2009 | Qian et al. | 343/700 MS |

FOREIGN PATENT DOCUMENTS

JP 2005109870 4/2005

OTHER PUBLICATIONS

Higginbotham, et al., "Tunable Permittivity of Polymer Composites through Incremental Blending of Raw and Functionalized Single-Wall Carbon Nanotubes" J. Phys. Chem. C, vol. 111, May 19, 2007, pp. 17751-17754.

* cited by examiner

*Primary Examiner* — Huedung Mancuso
(74) *Attorney, Agent, or Firm* — Winstead PC

(57) ABSTRACT

The present disclosure describes antennas based on a conductive polymer composite as replacements for metallic antennas. The antennas include a non-conductive support structure and a conductive composite layer deposited on the non-conductive support structure. The conductive composite includes a plurality of carbon nanotubes and a polymer. Each of the plurality of carbon nanotubes is in contact with at least one other of the plurality of carbon nanotubes. The conductive composite layer is operable to receive at least one electromagnetic signal. Other various embodiments of the antennas include a hybrid antenna structure wherein a metallic antenna underbody replaces the non-conductive support structure. In the hybrid antennas, the conductive composite layer acts as an amplifier for the metallic antenna underbody. Methods for producing the antennas and hybrid antennas are also disclosed. Radios, cellular telephones and wireless network cards including the antennas and hybrid antennas are also described.

28 Claims, 4 Drawing Sheets

ANTENNAS BASED ON A CONDUCTIVE POLYMER COMPOSITE AND METHODS FOR PRODUCTION THEREOF

This application claims priority to U.S. provisional patent application 61/058,352 filed Jun. 3, 2008, which is incorporated by reference herein in its entirety.

STATEMENT REGARDING FEDERALLY SPONSORED RESEARCH

Not applicable.

BACKGROUND

Antennas constitute a cornerstone of modern wireless communication technology. Antennas are designed to receive and emit electromagnetic radiation and to act as a conduit between free space and wireless devices. A basic requirement of conventional antennas is that they contain an electrical conductor. For this reason, most traditional antennas have been limited to metallic structures. For antenna applications in which weight is a consideration, metallic antennas can also be problematic in some instances.

In various structural applications, polymers and polymer composites have been used as a lightweight replacement for metals. Although certain polymers and polymer composites are electrically conductive or can be made electrically conductive, low conductivities have generally limited their use as a metal replacement in applications requiring electrical conductivity.

In view of the foregoing, non-metallic or at least partially non-metallic antenna structures would be of considerable utility in a variety of applications in which metallic antennas are conventionally used. The present disclosure describes antenna structures prepared from highly conductive polymer composites utilizing conductive carbon nanotubes as a filler material. These antenna structures provide an alternative approach to traditional antennas that are wholly metallic. Such non-metallic or at least partially non-metallic antenna structures are advantageous in having a lower weight than comparable metallic antennas and in offering significantly improved antenna efficiencies.

SUMMARY

In various embodiments, antennas are described herein. The antennas include a non-conductive support structure and a conductive composite layer deposited on the non-conductive support structure. The conductive composite includes a plurality of carbon nanotubes and a polymer. Each of the plurality of carbon nanotubes is in contact with at least one other of the plurality of carbon nanotubes. The conductive composite layer is operable to receive at least one electromagnetic signal.

In various embodiments, hybrid antennas are described herein. The hybrid antennas include a metallic antenna underbody and a conductive composite layer overcoating the metallic antenna underbody. The conductive composite layer includes a plurality of carbon nanotubes and a polymer. Each of the plurality of carbon nanotubes is in contact with at least one other of the plurality of carbon nanotubes. The conductive composite layer acts as an amplifier for the metallic antenna underbody.

In various embodiments, radios including the antennas and hybrid antennas are described. In various embodiments, cellular telephones including the antennas and hybrid antennas are described. In various embodiments, wireless network cards including the antennas and hybrid antennas are described.

In other various embodiments, methods for forming an antenna are described herein. The methods include providing a non-conductive support structure and depositing a conductive composite layer on the non-conductive support structure. The conductive composite layer includes a plurality of carbon nanotubes and a polymer. Each of the plurality of carbon nanotubes is in contact with at least one other of the plurality of carbon nanotubes. The conductive composite layer is operable to receive at least one electromagnetic signal.

In still other various embodiments, methods for forming a hybrid antenna are described herein. The methods include providing a metallic antenna underbody and depositing a conductive composite layer on the metallic antenna underbody. The conductive composite layer includes a plurality of carbon nanotubes and a polymer. Each of the plurality of carbon nanotubes is in contact with at least one other of the plurality of carbon nanotubes. The conductive composite layer acts as an amplifier for the metallic antenna underbody.

The foregoing has outlined rather broadly various features of the present disclosure in order that the detailed description that follows may be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1:
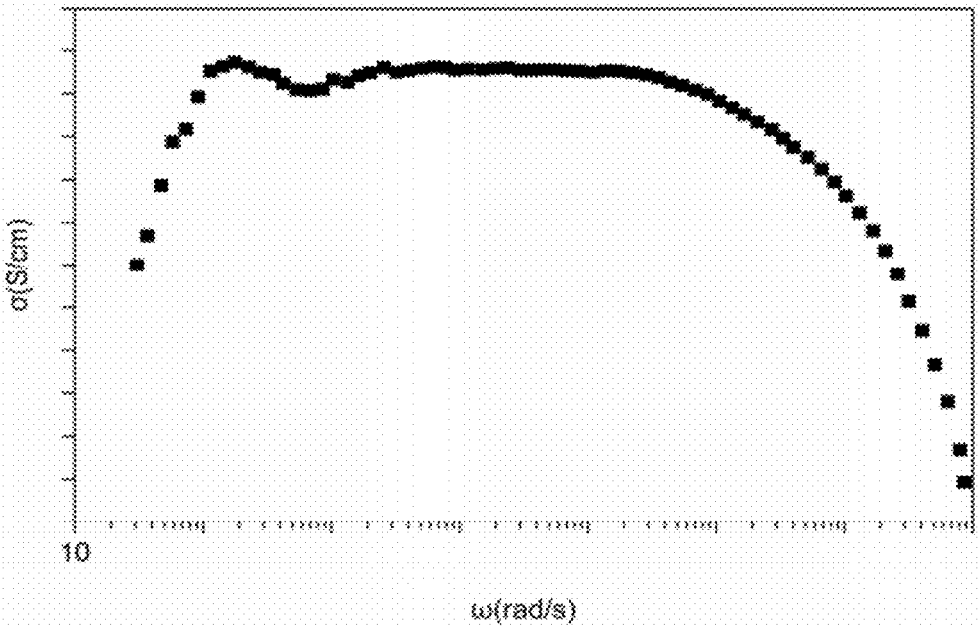
FIG. 1 presents an illustrative plot of conductivity in a carbon nanotube/polycarbonate composite as a function of measurement angle.

In the following description, certain details are set forth such as specific quantities, concentrations, sizes, etc. so as to provide a thorough understanding of the various embodiments disclosed herein. However, it will be apparent to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Furthermore, drawings are not necessarily to scale.

While most of the terms used herein will be recognizable to those of ordinary skill in the art, it should be understood that when not explicitly defined, terms should be interpreted as adopting a meaning presently accepted by those of ordinary skill in the art.

Various potential applications for carbon nanotubes have been proposed based on their superior mechanical and electrical properties. Many of these potential applications envision using the carbon nanotubes when disposed as a component in a polymer composite. Illustrative devices envisioned using carbon nanotubes include, for example, field emitters, sensors and various optoelectronic devices. In particular, for polymer composite applications, carbon nanotube filler materials are known to greatly enhance the electrical, thermal, optical and oftentimes the mechanical properties of the polymer composites by establishing a percolative network throughout the polymer host. Polymer composite applications of carbon nanotubes have typically focused on dispersed carbon nanotubes to take advantage of the mechanical strength of individualized carbon nanotubes. Likewise, electrically conducting carbon nanotube polymer composites have also typically focused on those having dispersed carbon nanotubes. However, the dynamics involved in electronic transport are different than those present in mechanical applications. Accordingly, as described herein, polymer composites having heavily aggregated carbon nanotubes provide advantageous benefits in supplying enhanced electrical conductivities, as compared to low-concentration percolation threshold polymer composites having dispersed carbon nanotubes.

In any of the various embodiments described herein, carbon nanotubes may be formed by any known technique and can be obtained in a variety of forms, such as, for example, soot, powder, fibers, buckypaper and mixtures thereof. The carbon nanotubes may be any length, diameter, or chirality as produced by any of the various production methods. In some embodiments, the carbon nanotubes have diameters in a range between about 0.1 nm and about 100 nm. In some embodiments, the carbon nanotubes have lengths in a range between about 100 nm and about 1 μm. In some embodiments, the chirality of the carbon nanotubes is such that the carbon nanotubes are metallic, semimetallic, semiconducting or combinations thereof. Carbon nanotubes may include, but are not limited to, single-wall carbon nanotubes (SWNTs), double-wall carbon nanotubes (DWNTs), multi-wall carbon nanotubes (MWNTs), shortened carbon nanotubes, oxidized carbon nanotubes, functionalized carbon nanotubes, purified carbon nanotubes, and combinations thereof. In some embodiments, the carbon nanotubes are MWNTs. In some embodiments, the carbon nanotubes are SWNTs.

In any of the various embodiments presented herein, the carbon nanotubes may be unfunctionalized or functionalized. Functionalized carbon nanotubes, as used herein, refer to any of the carbon nanotubes types bearing chemical modification, physical modification or combination thereof. Such modifications can involve the nanotube ends, sidewalls, or both. Illustrative chemical modifications of carbon nanotubes include, for example, covalent bonding and ionic bonding. Illustrative physical modifications include, for example, chemisorption, intercalation, surfactant interactions, polymer wrapping, salvation, and combinations thereof. Unfunctionalized carbon nanotubes are typically isolated as aggregates referred to as ropes or bundles, which are held together through van der Waals forces. In particular, the carbon nanotubes are in contact with one another. Carbon nanotube bundles may become even more densely aggregated using the processing techniques described herein.

Unfunctionalized carbon nanotubes may be used as-prepared from any of the various production methods, or they may be further purified. Purification of carbon nanotubes typically refers to, for example, removal of metallic impurities, removal of non-nanotube carbonaceous impurities, or both from the carbon nanotubes. Illustrative carbon nanotube purification methods include, for example, oxidation using oxidizing acids, oxidation by heating in air, filtration and chromatographic separation. Oxidative purification methods remove non-nanotube carbonaceous impurities in the form of carbon dioxide. Oxidative purification of carbon nanotubes using oxidizing acids further results in the formation of oxidized, functionalized carbon nanotubes, wherein the closed ends of the carbon nanotube structure are oxidatively opened and terminated with a plurality of carboxylic acid groups. Illustrative oxidizing acids for performing oxidative purification of carbon nanotubes include, for example, nitric acid, sulfuric acid, oleum and combinations thereof. Oxidative purification methods using an oxidizing acid further result in removal of metallic impurities in a solution phase. Depending on the length of time oxidative purification using oxidizing acids is performed, further reaction of the oxidized, functionalized carbon nanotubes results in shortening of the carbon nanotubes, which are again terminated on their open ends by a plurality of carboxylic acid groups. The carboxylic acid groups in both oxidized, functionalized carbon nanotubes and shortened carbon nanotubes may be further reacted to form other types of functionalized carbon nanotubes. In various embodiments of the present disclosure, the carbon nanotubes are carboxylated carbon nanotubes prepared by an oxidative purification procedure. In some embodiments, the carboxylated carbon nanotubes comprise carboxylated MWNTs. In other embodiments, the carboxylated carbon nanotubes comprise carboxylated SWNTs. In some embodiments of the present disclosure, the carbon nanotubes are unpurified. In other embodiments of the present disclosure, the carbon nanotubes are purified.

In various embodiments, the present disclosure describes conductive composite layers having carbon nanotubes and a polymer. In various embodiments of the carbon nanotube polymer composites of the present disclosure, the carbon nanotubes are in contact with at least one other of a plurality of carbon nanotubes. In particular, the carbon nanotubes are at least partially aggregated into bundles in the conductive composite layers. In some embodiments, the carbon nanotubes are more densely bundled in the conductive composite layers than in the as-produced carbon nanotubes.

Without being bound by any theory or mechanism, it is believed that by keeping the carbon nanotubes in close contact with one another, a ballistic transport of electrical signal results rather than a hopping transport mechanism. According to current understanding of the transport mechanism, the high electrical conductivities of the carbon nanotube polymer composites disclosed herein result from association of the carbon nanotubes into large and dense bundles that enable the polymer composites to carry charge at higher levels on the macroscale than polymer composites having dispersed carbon nanotubes on the microscale. Conductivities in polymer composites having dispersed carbon nanotubes are orders of magnitude lower.

In various embodiments, carbon nanotube polymer composites of the present disclosure are prepared through controlled blending of carbon nanotubes and a polycarbonate polymer. However, one of ordinary skill in the art will recognize that other polymer systems can be blended with the carbon nanotubes, while still operating within the spirit and scope of the present disclosure. Such controlled blending alters the composite morphology to produce heavily aggregated carbon nanotubes within the polymer composites, thus providing advantageous transport dynamics and electrical conductivities of about 1300 S/cm and greater. Advantageously, the carbon nanotube polymer composites have sufficient electrical conductivity such that they can be applied as a coating to provide electromagnetic antenna/amplifier transduction effects over a broadband frequency range into the GHz region.

In various embodiments herein, the conductive carbon nanotube polymer composites can be deposited as a thin film. Such thin films of conductive carbon nanotube polymer composites can demonstrate broadband signal processing capabilities in a frequency range from about 1 Hz to about 1000 GHz.

In various embodiments, antennas are described herein. The antennas include a non-conductive support structure and a conductive composite layer deposited on the non-conductive support structure. The conductive composite includes a plurality of carbon nanotubes and a polymer. Each of the plurality of carbon nanotubes is in contact with at least one other of the plurality of carbon nanotubes. The conductive composite layer is operable to receive at least one electromagnetic signal. In some embodiments, the carbon nanotubes are multi-wall carbon nanotubes. In other embodiments, the carbon nanotubes are single-wall carbon nanotubes.

In various embodiments, the conductive composite layer forms a continuous layer. In other various embodiments, the conductive composite layer forms a discontinuous layer.

The conductive composite layer has a thickness of about 1 μm to about 1 mm in some embodiments, from about 1 mm to about 1 cm in other embodiments, and from about 1 cm to about 10 cm in still other embodiments. In various embodiments, a frequency sent and received by the antenna is controlled by altering the thickness of the conductive composite layer.

In various embodiments, the conductive composite layer has an AC/DC conductivity that ranges from about 0.1 to about 10000 S/cm. In other various embodiments, the conductive composite layer has an AC/DC conductivity that ranges from about 1 to about 2000 S/cm. In still other various embodiments, the conductive composite layer has an AC/DC conductivity that ranges from about 1 to about 1500 S/cm. In some embodiments, the conductive composite layer has an AC/DC conductivity that is greater than about 1000 S/cm.

In various embodiments, a concentration of carbon nanotubes in the conductive composite layer ranges from about 0.1 to about 20 weight percent. In some embodiments, the concentration ranges from about 0.1 to about 10 weight percent.

In various embodiments of the antennas, the non-conductive support structure is elongated in order to give the antenna length. In some embodiments, the non-conductive support structure is a cylinder. In some embodiments, the non-conductive support structure is a hollow tube. In some embodiments, the non-conductive support structure is formed from a plastic.

In some embodiments, the conductive composite layer is deposited on the outer surface of the hollow tube. In some embodiments, the conductive composite layer is deposited on the inner surface of the hollow tube. In still other embodiments, the conductive composite layer is deposited on both the inner surface and outer surface of the hollow tube.

The antenna has a length of about 1 cm to about 1 m in some embodiments, from about 1 m to about 10 m in other embodiments, and up to about 50 m in still other embodiments. In various embodiments, a frequency sent and received by the antenna is controlled by altering the length of the antenna.

In various embodiments, the polymer comprising the conductive composite layer is a thermoplastic polymer or a thermosetting polymer, for example. Thermoplastic polymers include, for example, polyethylene, polypropylene, polystyrene, polyamides (nylons), polyesters, and polycarbonates. Thermosetting polymers include, for example, epoxies. In various embodiments, the polymer a polycarbonate. In various embodiments, the polymer wets the surface of the carbon nanotubes. In various embodiments, the conductive composite layer is formed by mixing a pre-formed polymer with the carbon nanotubes. In other various embodiments, the conductive composite layer is formed by mixing at least one monomer with the carbon nanotubes and then polymerizing the at least one monomer to form a polymer composite having the carbon nanotubes at least partially bundled.

In various embodiments, the conductive composite layer is deposited on to the non-conductive support structure using a technique such as, for example, dip coating, spin coating, printing, spray depositing, and combinations thereof. In various embodiments, the conductive composite layer is deposited on to the non-conductive support structure through a dip-coating technique. An illustrative dip coating technique is presented as an experimental example hereinbelow.

In various embodiments, the antennas are operable to receive at least one electromagnetic signal. In some embodiments, the at least one electromagnetic signal is a microwave signal. In some embodiments, the at least one electromagnetic signal is a radio signal.

In various embodiments, the antennas of the present disclosure are more efficient than wholly metallic antennas. As used herein, antenna efficiency will refer to the amount of losses occurring at the antenna terminals. Such losses occur through conduction and dielectric media as well as due to reflection as a result of mismatch between the antenna and an attached transmitter device.

In other various embodiments of the present disclosure, hybrid antennas are described herein. The hybrid antennas include a metallic antenna underbody and a conductive composite layer overcoating the metallic antenna underbody. The conductive composite layer includes a plurality of carbon nanotubes and a polymer. Each of the plurality of carbon nanotubes is in contact with at least one other of the plurality of carbon nanotubes. The conductive composite layer acts as an amplifier for the metallic antenna underbody.

In various embodiments of the hybrid antennas, the polymer is a polycarbonate. In some embodiments of the hybrid antennas, the carbon nanotubes are multi-wall carbon nanotubes. In some embodiments of the hybrid antennas, the carbon nanotubes are single-wall carbon nanotubes. In some embodiments of the hybrid antennas, the conductive composite layer is deposited on the metallic antenna underbody through a technique such as, for example, dip coating, spin coating, printing, spray depositing and combinations thereof.

The hybrid antenna has a length of about 1 cm to about 1 m in some embodiments, from about 1 m to about 10 m in other embodiments, and up to about 50 m in still other embodiments. The conductive composite layer has a thickness of about 1 μm to about 1 mm in some embodiments, from about 1 mm to about 1 cm in other embodiments, and from about 1 cm to about 10 cm in still other embodiments.

In various embodiments of the hybrid antennas, a concentration of carbon nanotubes in the conductive composite layer ranges from about 0.1 to about 20 weight percent. In some embodiments, the concentration ranges from about 0.1 to about 10 weight percent.

In various embodiments of the hybrid antennas, the conductive composite layer has an AC/DC conductivity that ranges from about 0.1 to about 10000 S/cm. In other various embodiments, the conductive composite layer has an AC/DC conductivity that ranges from about 1 to about 2000 S/cm. In still other various embodiments, the conductive composite layer has an AC/DC conductivity that ranges from about 1 to about 1500 S/cm. In some embodiments, the conductive composite layer has an AC/DC conductivity that is greater than about 1000 S/cm.

In various embodiments of the hybrid antennas, the metallic antenna underbody is completely overcoated by the conductive composite layer. In other various embodiments, the metallic antenna underbody is partially overcoated by the conductive composite layer. In some embodiments, the conductive composite layer is continuous. In some embodiments, the conductive composite layer is discontinuous.

In still other various embodiments of the present disclosure, methods for forming an antenna are described herein. The methods include providing a non-conductive support structure and depositing a conductive composite layer on the non-conductive support structure. The conductive composite layer includes a plurality of carbon nanotubes and a polymer. Each of the plurality of carbon nanotubes is in contact with at least one other of the plurality of carbon nanotubes. The conductive composite layer is operable to receive at least one electromagnetic signal.

In various embodiments of the methods, the non-conductive support structure is a cylinder. In various embodiments of the methods, the non-conductive support structure is a hollow tube. In some embodiments of the methods, the polymer is a polycarbonate. In some embodiments of the methods, the carbon nanotubes are multi-wall carbon nanotubes. In other various embodiments of the methods, the carbon nanotubes are single-wall carbon nanotubes.

In still other various embodiments of the present disclosure, methods for forming a hybrid antenna are described herein. The methods include providing a metallic antenna underbody and depositing a conductive composite layer on the metallic antenna underbody. The conductive composite layer includes a plurality of carbon nanotubes and a polymer. Each of the plurality of carbon nanotubes is in contact with at least one other of the plurality of carbon nanotubes. The conductive composite layer acts as an amplifier for the metallic antenna underbody.

In various embodiments of the methods, the polymer is a polycarbonate. In various embodiments of the methods, the carbon nanotubes are single-wall carbon nanotubes. In various embodiments of the methods, the carbon nanotubes are multi-wall carbon nanotubes.

In various embodiments of the methods the depositing step includes a technique such as, for example, dip coating, spin coating, printing, spray depositing and combinations thereof.

The antennas and hybrid antennas of the present disclosure may be used as a replacement antenna in any device using a metallic antenna. Such devices can include, for example, radios, cellular telephones, and wireless network cards. In various embodiments, radios including the antennas or hybrid antennas of the present disclosure are described herein. In various embodiments, cellular telephones including the antennas or hybrid antennas of the present disclosure are described herein. In various embodiments, wireless network cards or other wireless communication devices including the antennas or hybrid antennas of the present disclosure are described herein.

EXPERIMENTAL EXAMPLES

The following experimental examples are included to demonstrate particular aspects of the present disclosure. It should be appreciated by those of ordinary skill in the art that the methods described in the examples that follow merely represent exemplary embodiments of the disclosure. Those of ordinary skill in the art should, in light of the present disclosure, appreciate that many changes can be made in the specific embodiments described and still obtain a like or similar result without departing from the spirit and scope of the present disclosure.

Example 1

AC Conductivity of MWNT Composite Materials

Unpurified MWNTs with a low concentration of metal catalyst particles (based on TEM images) were weighed out and mixed with polycarbonate at various loading levels. The resulting suspensions were stirred for 48 hours at room temperature in air. AC conductivity of the resulting polymer composites as a function of MWNT loading is shown in Table 1.

TABLE 1

AC Conductivity of MWNT/Polycarbonate Composites

| MWNT Loading (wt %) | AC Conductivity (S/cm) |
|---|---|
| 0.19 | 10.13 ± 1.52 |
| 0.28 | 11.24 ± 1.67 |
| 0.60 | 26.0 ± 5.58 |
| 0.89 | 84.75 ± 5.56 |
| 1.17 | 122.95 ± 6.12 |
| 1.98 | 336.05 ± 23.11 |
| 7.23 | 736.275 ± 12.34 |
| 9.28 | 1598.35 ± 113.70 |
| 14.7 | 1652.17 ± 86.30 |

FIG. 1 presents an illustrative plot of conductivity in a carbon nanotube/polycarbonate composite as a function of measurement angle.

Example 2

Physical Characterization of MWNT Composite Materials

Figure 2A:
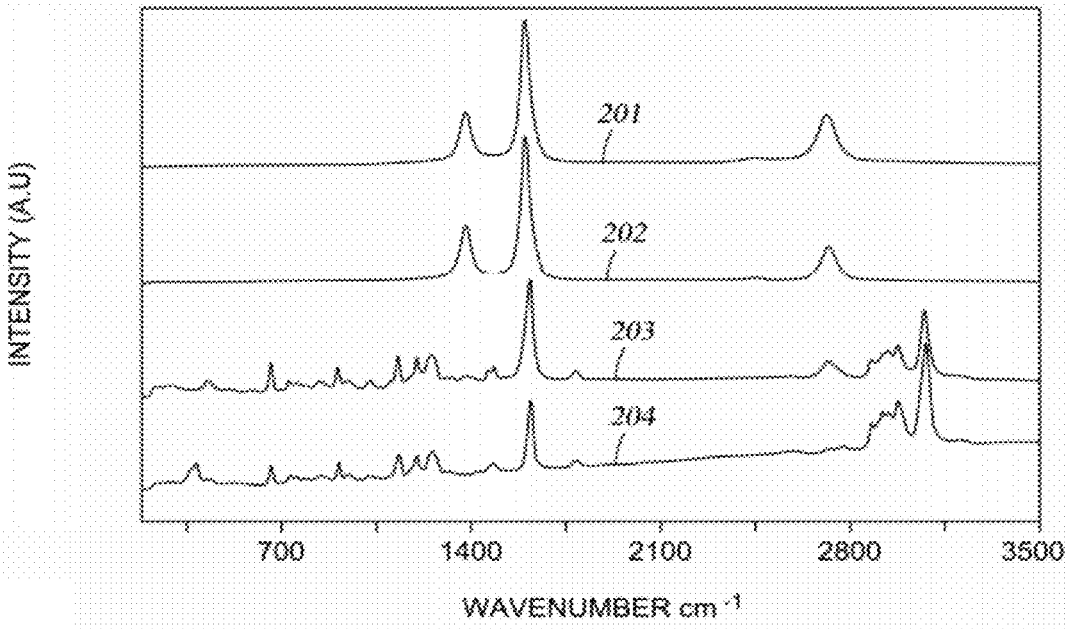
FIGS. 2A-2C present illustrative Raman spectra of purified MWNTs, non-purified MWNTs, a MWNT-polycarbonate polymer composite, and pristine polycarbonate polymer at wavelengths of 488, 514, and 785 nm, respectively.
Figure 2B:
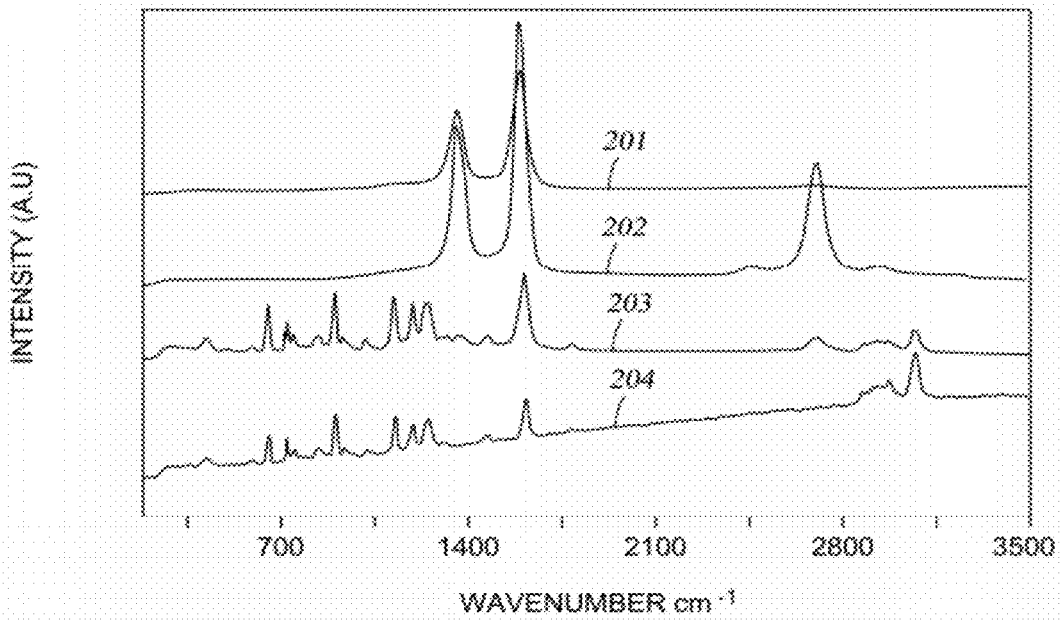
Figure 2C:
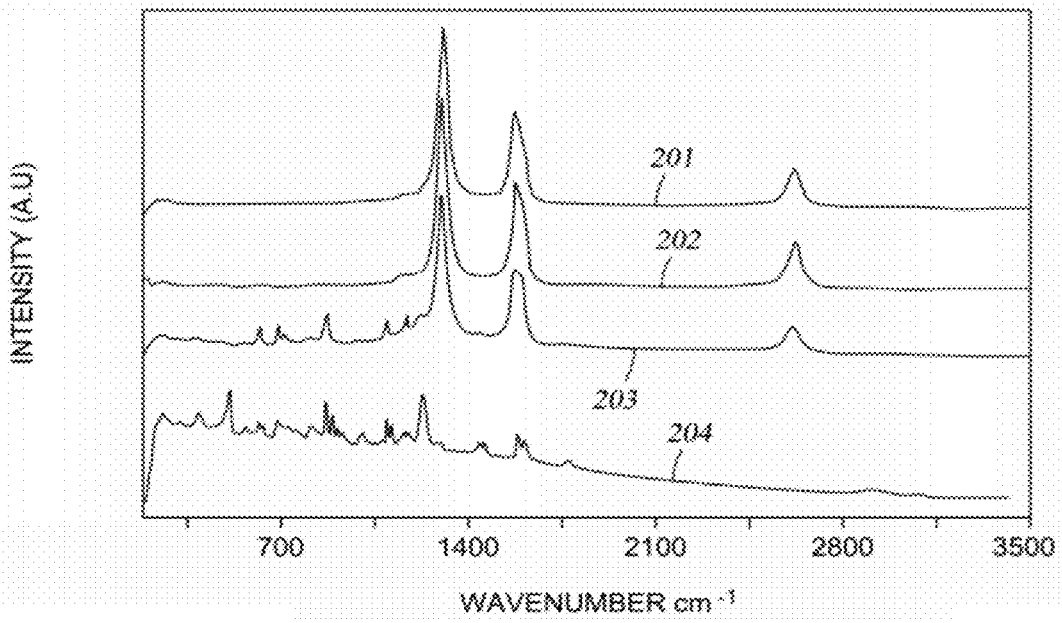

FIGS. 2A, 2B and 2C present illustrative Raman spectra of purified MWNTs (201), unpurified MWNTs (202), a MWNT-polycarbonate composite (203), and a pristine polycarbonate polymer (204), respectively. Excitation wavelengths of 488 nm (FIG. 2A), 514 nm (FIG. 2B) and 785 nm (FIG. 2C) were used. In the Raman spectra of MWNTs, broadness in the D peak is generally understood to represent not just defects such as amorphous carbon, but also is characteristic of voids, haeckelite, and variations in nanotube lengths and widths. As shown in FIGS. 2A-2C, the D and G peaks for unpurified and acid treated (purified) carbon nanotubes had typical strong intensities. In contrast, the D peak was significantly reduced at all wavelengths tested for the MWNT polymer composite material.

Figure 3:
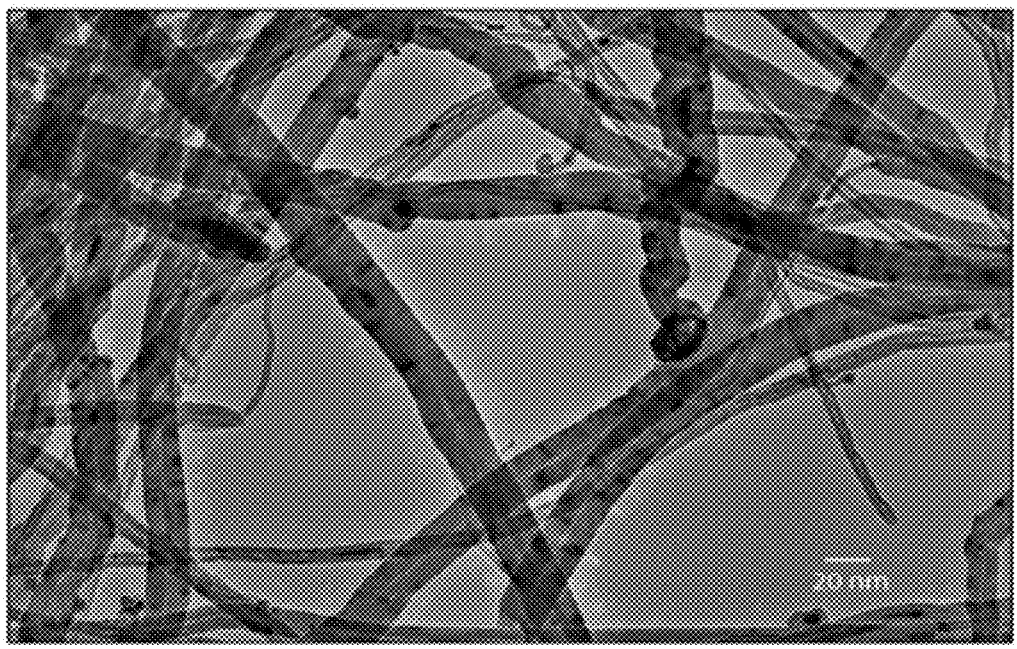
FIG. 3 presents an illustrative TEM image of the MWNTs used in the polymer composites before polymer composite formation.
Figure 4:
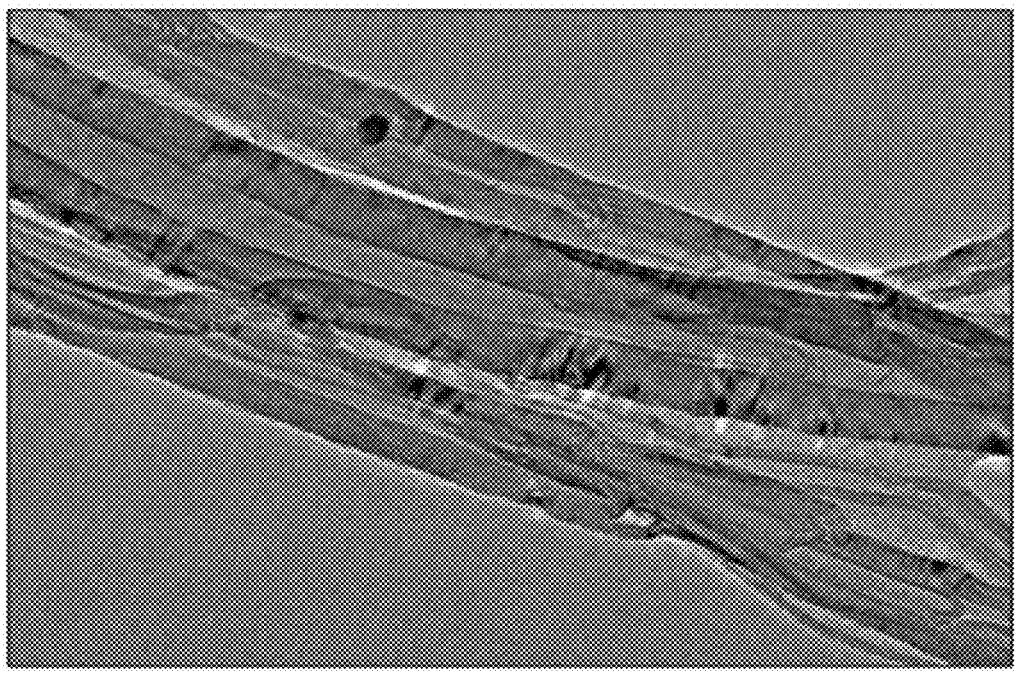
FIG. 4 presents an illustrative TEM image of MWNTs after polymer composite formation, showing tight bundling of the MWNTs with each other and surrounded by polymer.

It is known that long mixing times of carbon nanotubes with polymers can lead increased aggregation of the carbon nanotubes within the resulting polymer composites to provide dense carbon nanotube bundles. To prepare the highly conductive polymer composites utilized in the present disclosure, stirring of the carbon nanotubes with the polymer material was conducted for extended periods of time to promote dense bundling and polymer wetting of the carbon nanotubes. FIG. 3 presents an illustrative TEM image of the MWNTs used in the polymer composites before polymer composite formation. FIG. 4 presents a illustrative contrasting TEM image of the MWNTs after polymer composite formation, showing tight bundling of the MWNTs with each other and surrounded by polymer. Conductivities of the resultant polymer composites have been previously shown in Table 1. Generally, conductivities were higher for polymer composites prepared from unpurified MWNTs compared to those made from purified MWNTs. Conductivities shown in Table 1 are comparable to those of buckypaper formed from SWNTs.

The electrical conductivities of the polycarbonate/carbon nanotube composites can be described by the scaling law based on percolation theory. The scaling law [$\sigma_{DC}=(p-p_C)$™] is used to describe the percolation process, where $\sigma_{DC}$ is the conductivity, $\sigma_o$ is the conductivity of the filler, p is the weight fraction of the nanotubes and $p_c$ is the initial conductivity above which the material behaves like a conductor. The exponent t is related to sample dimensionality where t~1, t~1.33 and t~2.0 corresponds to one, two and three dimensions respectively. Curve fitting of the scaling law equation gave the percolation threshold as $p_c$=0.20 wt %, t 1.39 for purified MWNTs and $p_c$=0.19 wt %, t=0.97 for unpurified MWNTs. Based on these results for unpurified compared to purified MWNTs, the onset of percolation is about the same, but the dimensionality terms are different. Clearly, carrier dimensionality is dramatically changed in the purified samples.

Example 3

Fabrication of a Non-Metallic Antenna

Figure 5:
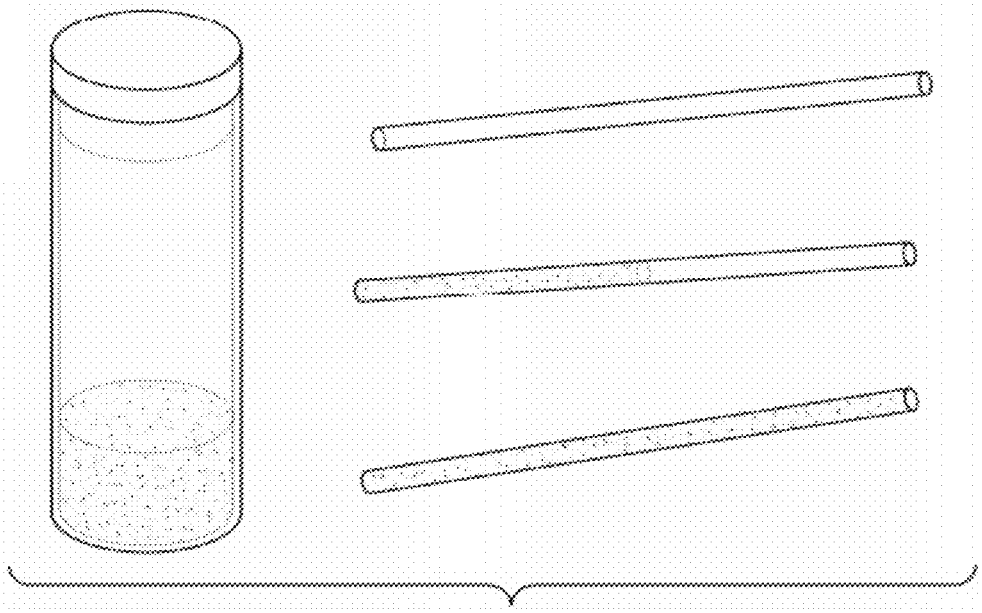
FIG. 5 presents a photograph of an illustrative non-metallic antenna.

Using the 7.23 weight percent carbon nanotube composite prepared as described in Example 1, a small, thin, hollow, plastic rod (length=4.97 cm, diameter=0.30 cm) was dipped in the composite material until a thin continuous layer of composite was deposited on the plastic rod. FIG. 5 presents a photograph of an illustrative non-metallic antenna prepared as described in this example.

Figure 6:
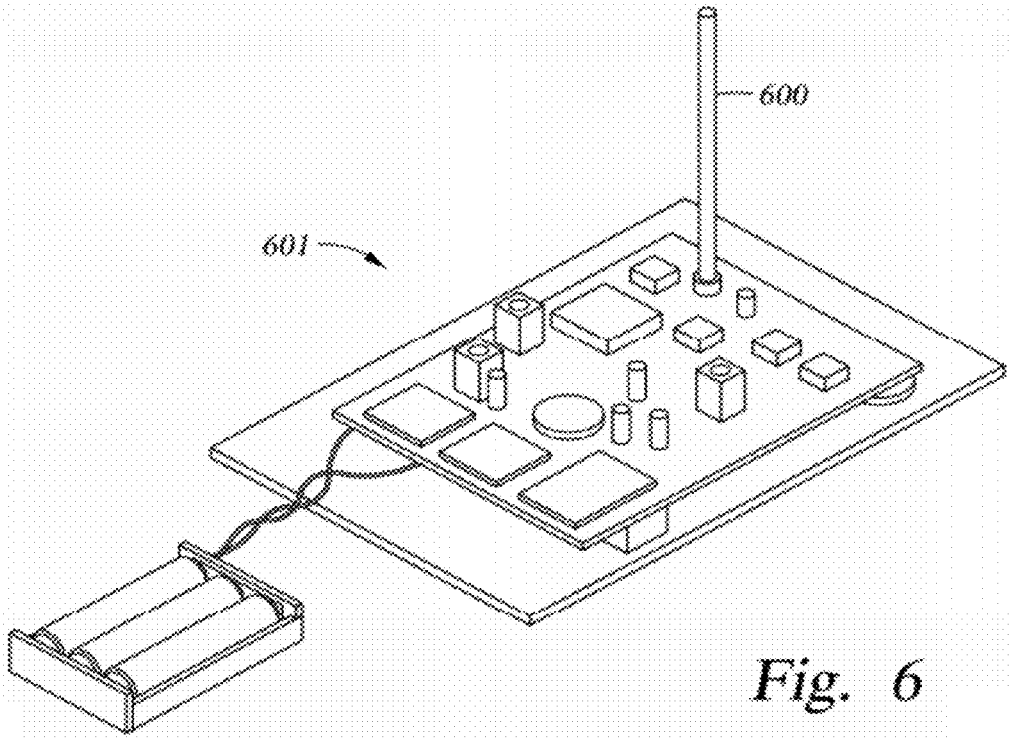
FIG. 6 presents a photograph of an illustrative non-metallic antenna connected to a radio.

When connected to a simple radio in place of the conventional antenna, signal reception over a wide range of frequencies was observed. FIG. 6 presents a photograph of an illustrative non-metallic antenna 600 connected to a radio 601. Frequency reception over a range of 5 Hz to 13 MHz was measured using an oscilloscope.

Example 4

Operational Parameters of a Non-Metallic Antenna

For the antenna prepared in Example 3, the resonant frequency, standing wave ratio (SWR), and impedance were measured. According to the description provided in Example 3, the antenna was constructed in the form of a traditional ¼ wave vertical (of approximately 5 cm length) with a square ground plane of approximately ½ wavelength from corner to corner or twice the length of the vertical element.

The center frequency of the antenna was 1.63 GHz with a resonant dip of −4.3 db. The SWR was 3.78 at this frequency, and the impedance was Z=56−175 for a capacitive load of 1.3 pf. The resonance was rather shallow and broad, which indicates that this embodiment of the antenna has a limited efficiency but broad bandwidth. The ½ dip points around the center frequency were 1.1082 GHz and 2.2231 GHz. The points at which the imaginary component of the impedance fell to zero and translated to a transition from capacitive to inductive loading were 1.47 GHz with Z=211 and 2.0 GHz with Z=7.

Example 5

Operational Parameters of a Metallic Antenna

Comparative Example

Comparison of the performance of the antenna of Example 4 against a traditional copper ¼ wavelength vertical antenna with the same ground plane was also performed. For the copper antenna, the center frequency was 1.227 GHz with a resonant dip of −7.5 db. The impedance at resonance was Z=28.6−130.43, providing an SWR of 2.3. At resonance, the loading was capacitive at 4 pf, but the resonant frequency was considerably lower than that of the equal length antenna of Example 4. The ½ dip points were at 1.091 GHz and 1.39 GHz, and the imaginary component fell to zero at 1.17 GHz (Z=192) and 1.330 GHz (Z=16.4).

Example 6

Coupling of the Non-Metallic Antenna to the Metallic Antenna

The traditional copper ¼ wave antenna of Example 5 was coupled on to the non-metallic antenna of Example 3 to produce a coupled antenna. The coupled antenna had a lowered resonant frequency to 976 MHz but increased resonant dip of −14.275 db. The SWR at resonance was 1.5, and the impedance was Z=37+i12.1. The ½ dip points (~−7 db) were at 839.25 MHz and 1.2557 MHz, and the points at which the imaginary component vanished were 614 MHz (Z=4) and 1.6 GHz (Z=106). The operational parameters of the coupled antenna are interesting, particularly in light of the coupled antenna's greatly increased efficiency (inductive loading=1.9 nH at resonance). In the coupled antenna, the carbon nanotube composite acts in a dual capacity both as a resonance amplifier by lowering the frequency and as a dielectric by compensating for the capacitive loading in the cable and connector.

From the foregoing description, one of ordinary skill in the art can easily ascertain the essential characteristics of this disclosure, and without departing from the spirit and scope thereof, can make various changes and modifications to adapt the disclosure to various usages and conditions. The embodiments described hereinabove are meant to be illustrative only and should not be taken as limiting of the scope of the disclosure, which is defined in the following claims.

What is claimed is the following:

1. An antenna comprising:

a non-conductive support structure; and a conductive composite layer deposited on the non-conductive support structure;

wherein the conductive composite layer comprises a plurality of carbon nanotubes and a polymer;

wherein each of the plurality of carbon nanotubes is in contact with at least one other of the plurality of carbon nanotubes; and wherein the conductive composite layer is operable to receive at least one electromagnetic signal.

2. The antenna of claim 1, wherein the non-conductive support structure comprises a cylinder.

3. The antenna of claim 1, wherein the non-conductive support structure comprises a hollow tube.

4. The antenna of claim 1, wherein the polymer is a polycarbonate.

5. The antenna of claim 1, wherein the carbon nanotubes are multi-wall carbon nanotubes.

6. The antenna of claim 1, wherein the carbon nanotubes are single-wall carbon nanotubes.

7. The antenna of claim 1, wherein the at least one electromagnetic signal is a radio signal.

8. The antenna of claim 1, wherein an AC/DC conductivity of the conductive composite layer ranges from about 0.1 to about 10,000 S/cm.

9. The antenna of claim 1, wherein the conductive composite layer is deposited on the non-conductive support structure through a technique selected from the group consisting of dip coating, spin coating, printing, spray depositing, and combinations thereof.

10. The antenna of claim 1, wherein a concentration of carbon nanotubes in the conductive composite layer ranges from about 0.1 to about 20 weight percent.

11. An hybrid antenna comprising:

a metallic antenna underbody; and a conductive composite layer overcoating the metallic antenna underbody;

wherein the conductive composite layer comprises a plurality of carbon nanotubes and a polymer;

wherein each of the plurality of carbon nanotubes is in contact with at least one other of the plurality of carbon nanotubes; and wherein the conductive composite layer acts as an amplifier for the metallic antenna underbody.

12. The hybrid antenna of claim 11, wherein the polymer is a polycarbonate.

13. The hybrid antenna of claim 11, wherein the carbon nanotubes are multi-wall carbon nanotubes.

14. The hybrid antenna of claim 11, wherein the carbon nanotubes are single-wall carbon nanotubes.

15. The hybrid antenna of claim 11, wherein the conductive composite layer is deposited on the metallic antenna underbody through a technique selected from the group consisting of dip coating, spin coating, printing, spray depositing, and combinations thereof.

16. A method for forming an antenna, said method comprising:

providing a non-conductive support structure; and depositing a conductive composite layer on the non-conductive support structure;

wherein the conductive composite layer comprises a plurality of carbon nanotubes and a polymer;

wherein each of the plurality of carbon nanotubes is in contact with at least one other of the plurality of carbon nanotubes; and wherein the conductive composite layer is operable to receive at least one electromagnetic signal.

17. The method of claim 16, wherein the non-conductive support structure comprises a cylinder.

18. The method of claim 16, wherein the non-conductive support structure comprises a hollow tube.

19. The method of claim 16, wherein the polymer is a polycarbonate.

20. The method of claim 16, wherein the carbon nanotubes are multi-wall carbon nanotubes.

21. The method of claim 16, wherein the carbon nanotubes are single-wall carbon nanotubes.

22. The method of claim 16, wherein the depositing step comprises a technique selected from the group consisting of dip coating, spin coating, printing, spray depositing, and combinations thereof.

23. A method for forming a hybrid antenna, said method comprising:

providing a metallic antenna underbody; and depositing a conductive composite layer on the metallic antenna underbody;

wherein the conductive composite layer comprises a plurality of carbon nanotubes and a polymer;

wherein each of the plurality of carbon nanotubes is in contact with at least one other of the plurality of carbon nanotubes; and wherein the conductive composite layer acts as an amplifier for the metallic antenna underbody.

24. The method of claim 23, wherein the polymer is a polycarbonate.

25. The method of claim 23, wherein the carbon nanotubes are multi-wall carbon nanotubes.

26. The method of claim 23, wherein the carbon nanotubes are single-wall carbon nanotubes.

27. The method of claim 23, wherein the conductive composite layer is deposited on the metallic antenna underbody through a technique selected from the group consisting of dip coating, spin coating, printing, spray depositing, and combinations thereof.

28. A radio comprising the antenna of claim 1.

* * * * *